United States Patent [19]

Jang et al.

[11] Patent Number: 4,773,288

[45] Date of Patent: Sep. 27, 1988

[54] ADJUSTABLE VISE GRIP

[76] Inventors: Young H. Jang; Hyang S. J. Park, both of Apartado 7902, Panama 9, Panama

[21] Appl. No.: 59,753

[22] Filed: Jun. 8, 1987

[51] Int. Cl.[4] ..... B25B 7/04

[52] U.S. Cl. ..... 81/409.5; 81/412

[58] Field of Search ..... 81/407–412, 81/177.85, 413, 385

[56] References Cited

U.S. PATENT DOCUMENTS 3,208,318 9/1965 Roberts ..... 81/177.85

4,269,089 5/1981 Hastings ..... 81/409.5

FOREIGN PATENT DOCUMENTS 1255142 1/1961 France ..... 81/411

*Primary Examiner*—Frederick R. Schmidt

*Assistant Examiner*—Bradley I. Vaught

*Attorney, Agent, or Firm*—Roger A. Marrs

[57] ABSTRACT

An adjustable vise grip is disclosed herein having a pair of lever members joined together adjacent one end by a sliding adjustable lock mechanism carried on one member passing through a slot in the other member. The mechanism includes a spring biased plunger having a stepped end for urging a ball into selected ones of openings provided in the slot on the other member. Jaw portions carried on the extreme ends of said members cooperate to grip a workpiece when pivoted about the lock mechanism.

2 Claims, 1 Drawing Sheet

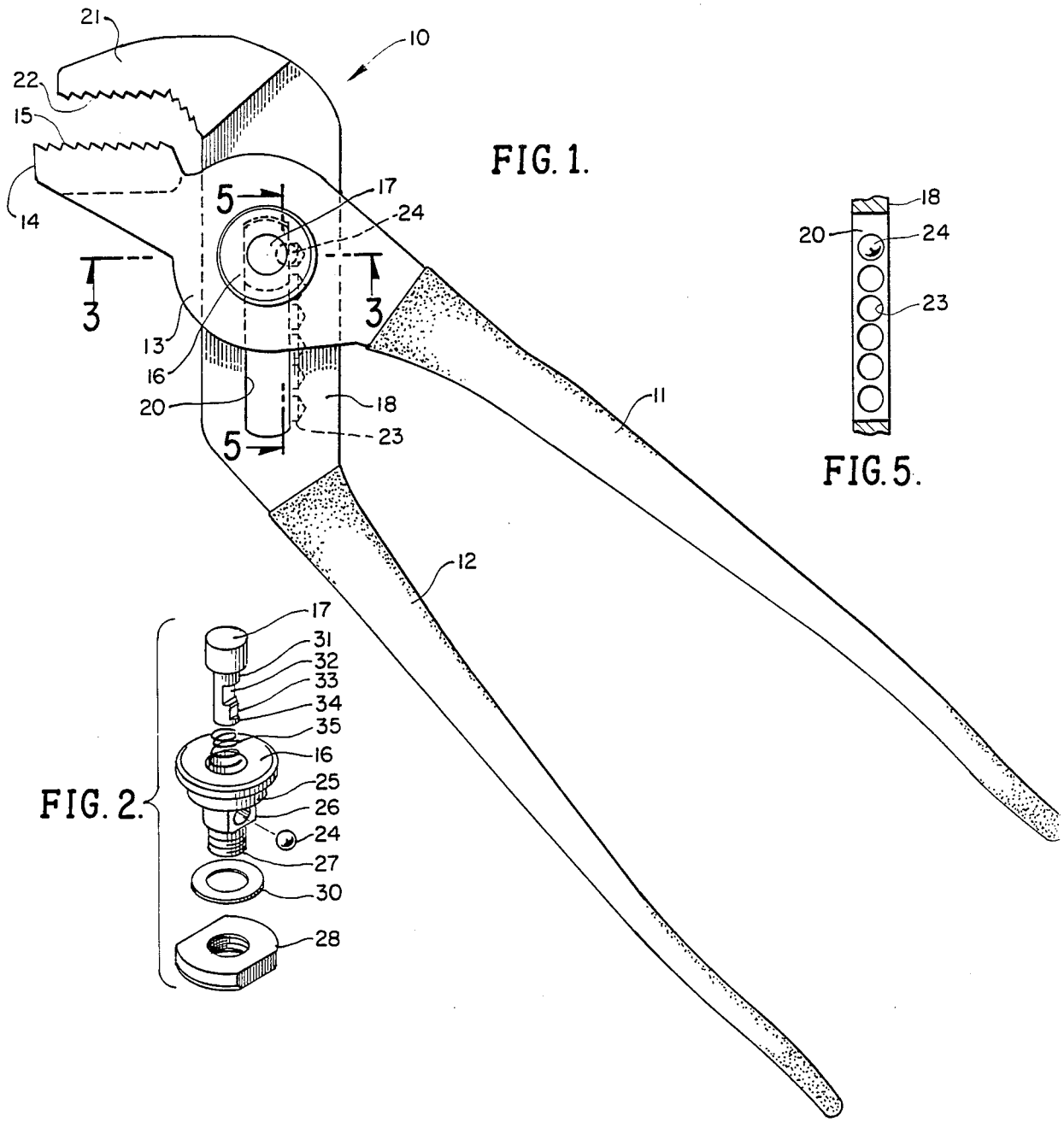
FIG. 1.
FIG. 5.
FIG. 2.
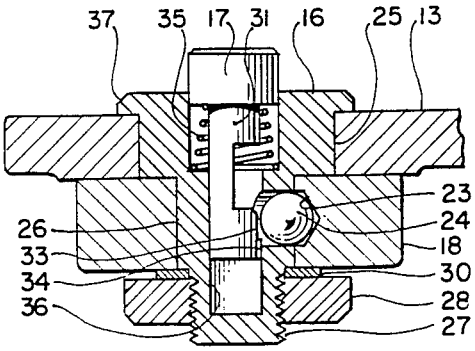
FIG. 3.
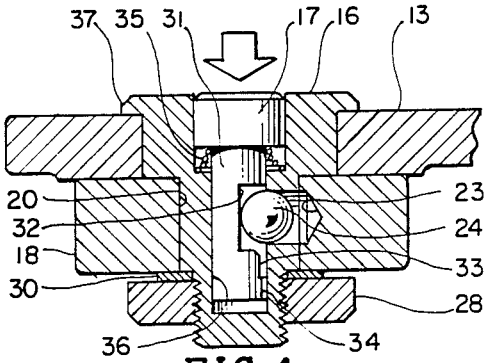
FIG. 4.

ADJUSTABLE VISE GRIP

BACKGROUND OF THE INVENTION

1. Field of the Invention

This invention relates to the field of hand tools and more particularly to a novel tool of the channel or vise grip type providing improved gripping features and convenient push-button operation between an operative position and an adjust position.

2. Brief Description of the Prior Art

In the past, hand tools such channel grips employ cross-over junction of the hand grips wherein on grip is reduced in thickness to accommodate the other grip. Not only does this thickness reduction lessen the overall strength of the grips but a plurality of grooves are also employed which further reduces strength. The additional grooves are required as a part of the adjustment mechanism for setting the distance between the opposing surfaces of the grip jaws. The grooves function in connection with insertable members such a ball or the like which is moved between grooves for the adjustment. Such an adjustment requires both hands of the user which is cumbersome and awkward.

Also, the use of channel grooves limits the number of positions available for adjustment since the provision of grooves requires not only space for the grooves per se but for wedges between grooves against which the ball or other drive member will operate. Such construction greatly reduces the number of teeth used in the jaws or the length of the flat land gripping surfaces of the jaws when teeth are not used.

Therefore, a long standing need exists for a novel channel lock type or vise grip type hand tool or pliers which has greatly improved strength and load handling characteristics and which may be readily adjusted by the use of one hand.

SUMMARY OF THE INVENTION

Accordingly, the above problems and difficulties are obviated by the present invention which provides a novel plier hand tool having a pair of crossed-over handle grips which are pivotally coupled together by a adjustable pivot mechanism. The mechanism includes a spring biased releasable lock means that is single hand operated for adjusting the distance between the jaws carried on the ends of the handle grips. The pivot mechanism includes means suitable between an adjustment position and an operative or lock position securing the jaws in a fixed position. The lock means takes the form of a movable ball position by a multilevel plunger to selective engage and occupy one of a plurality of openings provided in the other of the handle grips.

Therefore, it is among the primary objects of the present invention to provide a novel hand tool of the channel grip or lock type that can be operated single handled by push button operation of a movable ball into and out of selected hand grip openings.

Another object of the invention resides in providing a hand tool of a channel or vise grip type with increased strength per material area for greater load bearing characteristics.

Still another object is provided an economical and simple-to-operate hand tool with a push button adjustable locking mechanism.

Yet a further object is to provide a hand tool having many positions of adjustment without reducing the strength or load handling characteristics of the tool.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side view of the novel vise grip or plier type and tool incorporating the present invention:

FIG. 2 is an enlarged exploded view of the adjustable lock mechanism used in the tool of FIG. 1;

FIG. 3 is a transverse cross sectional view of the lock mechanism taken in the direction of arrows 3—3 of FIG. 1 showing the mechanism in a lock or operative position;

FIG. 4 is a view similar to the view of FIG. 3 showing the mechanism in a transistional or adjustment position; and FIG. 5 is a sectional view of the lock ball and selective openings shown in FIG. 1 as taken along lines 5—5 thereof.

DESCRIPTION OF THE PREFERRED EMBODIMENT

Referring to FIG. 1, the novel adjustable hand tool of the present invention is indicated in the general direction of arrow 10 which includes a pair of grip arms 11 and 12 which include hand grips which are covered with a cushion material such as rubber, hard plastic or the like. Arm 11 terminates in an enlarged portion 13 having an outwardly projecting jaw member 14 having a plurality of teeth 15 arranged along its gripping surface. The enlarged portion 13 includes a central opening which is occupied by an adjustment means taking the form of a flanged mount 16 and a spring biased button which is operated to place the tool in a neutral position for adjustment or in a locked position when the tool is used.

Arm 12 includes an elongated midsection 18 having an elongated slot 20 disposed therein for slidably receiving the shank of fitting or mount 16. The arm 12 terminates in a jaw member 21 having a plurality of gripping teeth 22 intended to cooperate with the teeth 15 on jaw member 14 during use of the tool. The slot 20 includes a plurality of spaced-apart recesses such as recess 23 for selectively receiving a ball 24 which locks the members together when the ball occupies a selective opening.

FIG. 5 more clearly shows that the recesses are arranged in a linear row in spaced-apart relationship and that the ball 24 is occupying the uppermost recess of the series.

Referring now in detail to FIG. 2, an exploded view of the adjustment mechanism is illustrated wherein the fixture or mounting 16 includes a shank having a central circular portion 25 that is received into the central opening of the arm portion 13 and a reduced portion 26 adapted to slide through the slot 20 when the ball 24 is in its neutral position. The shank terminates on the external side of arm section 18 in a threaded stud 27 that is threadably engaged with a nut 28. A washer 30 separates the nut from the external surface of the arm section 18.

It can also be seen in FIG. 2 that the button 17 includes an elongated shank 31 which is provided with a deep cutout 32 adjacent to a shallow cutout 33 which is immediately adjacent to the terminating end of the pink shank 31, but is separated therefrom by a slight shoulder 34. A spring 35 is of the coil type and is based within a recess on fitting or mount 16 and the end of the pin shank 31 passes through the coil spring 35 into a bore 36 within the mount or fitting 16. The bore is more clearly illustrated in FIG. 3. The upper portion of the spring 35 bears against the undersurface of the button 17 about the shank 31 so that the button is normally urged or biased into a raised position above the surface of the fitting or mount 16.

As seen more clearly in FIG. 3, the adjustable means is arranged so that the fitting or mount 16 has its enlarged portion 25 residing within the central opening of the arm portion 13 and a flange 37 maintains the fitting or mount in position in cooperation with the nut 28 bearing against washer 30 and the exterior surface of the arm portion 18. The spring 35 normally biases the button outwardly and, in its locked position, the ball 24 occupies the recess 23 and the shallow cutout 33 bears against the ball with the shoulder 34 preventing the dislodgement of the pin from its mounting as the spring biases the pin outwardly. It can also be seen that the spring 35 resides within a central cavity which is partially occupied by the lower portion of the button 17. Therefore, the spring is hidden from external view and the button can operate in a limited and restricted linear action between a lock and unlock position. As shown in FIG. 3, the button is in the locked position with the ball occupying the recess 23. Therefore, the ball serves as a connection between the movable arms so that movement is prevented. The arm section 28 cannot rotate about the fixture or mounting shank 26 because the ball interconnects the fitting or mount 16 with the arm portion 18 of the arm 12. It is to be particularly noted that during the locked position, the arm 11 and its midportion 13 can easily rotate about the pivot portion 25 of the mounting. However, the mount or fixture 16 is stationary with respect to the arm 12 and its midsection 18. Upon depression of the button 17 against the bias of spring 35, the mounting or fixture 16 can move in a linear or rectilinear direction along with arm 11 along the length of the slot 20. This is achieved as shown in FIG. 4. In FIG. 4, the button 17 has been depressed against the spring 35 which extends the shank of the pin further into the bore 36 so that the ball 24 drops into the depth of the deep recess 32. Since the deep recess 32 is of greater depth or dimension than the shallow step 33, the ball 24 will leave the recess 23 and be totally within the confines of the mount or fixture 16. Thus, the interconnection between the arm portion 18 and the mount or fixture 16 has been removed so that sliding movement of the mount or fitting 16 can be achieved through the slot 20. Once the desired jaw opening has been selected, the pushbutton is released so that the ball is forced into a mating recess 23 as the pin moves outwardly from the fitting so that the shallow step on the shank 31 urges the ball into the recess.

It should be emphasized that the mount or fitting 16 never permits the member portion 18 of arm 12 to rotate thereabout. Rotation of the arm central portion 13 of arm 11 will always rotate about the fitting or mount 16 and its pivot portion 25. Depression of the pushbutton only permits sliding of the mounting or fixture along the slot 20 of the arm 12 central portion 18 until the proper jaw setting is achieved wherein the button can be released and the ball 24 will enter a selected one of the recesses 23 to provide the locking arrangement between the fitting or mount 16 and the midsection portion 18 of arm 12.

Therefore, it can be seen that the distance between the jaw teeth 15 and 22 can readily be adjusted by moving the arm 11 along the length of the slot 20 of arm 12. The mount or fitting 16 is carried on the midsection 13 of the arm 11 and a portion of its shank moves through the slot 20 in response to manual displacement of the arms with respect to each other. Upon release of the button and alignment of the ball with a selected recess 23, fixed engagement occurs between the mount or fitting 16 so that movement through the slot is prevented. However, rotation of the arm 11 about the fitting or mounting is permitted.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hand tool of the vise grip type comprising:

a pair of elongated handle members pivotally joined together adjacent respective ends thereof;

pivot means joining said members comprising an elongated slot provided in a first handle member and a lock mechanism carried on a second handle member extending through said slot;

said pivot means further comprising a spring biased plunger having a stepped end of at least two levels and a plurality of spaced-apart openings provided in said second handle member opening into said slot;

a ball movably carried in said slot operably disposed into and out of selected ones of said openings in response to a selected one of said levels on said plunger when said plunger is biased outward to its normal at rest position;

said plunger includes a button carried on its end opposite from its end carrying said levels;

said plunger button externally exposed when said plunger is in its at rest position;

said lock mechanism further includes a spacer element disposed between said pair of members having an elongated shank provided with an opening for movably retaining said ball;

said shank opening adapted to be aligned with a selected one of said second handle member openings; and said shank having a central bore for insertably receiving said spring biased plunger.

2. The invention as defined in claim 1 wherein:

said shank has a first flat level defined by a recess therein and second flat level raised above and coextensively with said first level;

said ball occupying said recess on said first level when said plunger is depressed against the normal spring bias so as to permit uninhibited movement of said members; and said ball abutting said second level and partially occupying a selected one of said other one member openings so as to lock and bind between said retainer shank and said other one member when said plunger is in its normal spring biased position with said button portion external of said second handle member.

* * * * *